US008607671B2

(12) United States Patent
Peirce et al.

(10) Patent No.: US 8,607,671 B2
(45) Date of Patent: Dec. 17, 2013

(54) WRENCH WITH TRIGGER

(75) Inventors: John M. Peirce, Portage, MI (US); Logan D. Pitts, North Muskegon, MI (US)

(73) Assignee: American Grease Stick Company, Muskegon Heights, MI (US)

( * ) Notice: Subject to any disclaimer, the term of this patent is extended or adjusted under 35 U.S.C. 154(b) by 206 days.

(21) Appl. No.: 13/196,985

(22) Filed: Aug. 3, 2011

(65) Prior Publication Data

US 2012/0031238 A1 Feb. 9, 2012

Related U.S. Application Data

(60) Provisional application No. 61/371,275, filed on Aug. 6, 2010.

(51) Int. Cl.
*B25B 13/10* (2006.01)
*B25B 13/46* (2006.01)

(52) U.S. Cl.
USPC ..... 81/58; 81/64

(58) Field of Classification Search
USPC ..... 81/58, 64, 98, 99
See application file for complete search history.

(56) References Cited

U.S. PATENT DOCUMENTS

| | | | | |
|---|---|---|---|---|
| 208,057 | A | | 9/1878 | Beck |
| 610,450 | A | | 9/1898 | Johnston |
| 651,574 | A | | 6/1900 | Meredith |
| 1,215,726 | A | | 2/1917 | Shew |
| 1,286,926 | A | | 12/1918 | Brightly |
| 1,526,304 | A | | 2/1925 | Chamberlain |
| 1,664,391 | A | * | 4/1928 | Aschroft ..... 81/58 |
| 1,675,748 | A | | 7/1928 | Bunker |
| 2,013,209 | A | * | 9/1935 | Hargreaves ..... 81/3.43 |
| 2,331,339 | A | | 10/1943 | Morris |
| 2,764,049 | A | * | 9/1956 | Hartung ..... 81/58 |
| 2,766,648 | A | | 10/1956 | Jazwieck |
| 2,824,476 | A | | 2/1958 | Wilson |
| 2,846,910 | A | | 8/1958 | Brown |

(Continued)

FOREIGN PATENT DOCUMENTS

| | | |
|---|---|---|
| DE | 599682 | 7/1937 |
| DE | 1110580 | 7/1961 |

(Continued)

OTHER PUBLICATIONS

International Search Report and Written Opinion for corresponding PCT Application No. PCT/US2011/046353, dated May 30, 2012.

*Primary Examiner* — David B Thomas
(74) *Attorney, Agent, or Firm* — Gardner, Linn, Burkhart & Flory, LLP

(57) ABSTRACT

A wrench for applying a drive torque at a drive element includes an elongated handle, a clamping element or head having a torque-applying gripping surface, and at least one trigger. The head is adjustably or movably mounted at the handle and is adjustable or movable to impart a clamping force at a drive element received at the gripping surface of the head. The trigger is configured to adjust or move the head relative to the handle to impart the clamping force at the drive element. Responsive to a user actuating the trigger, the trigger adjusts or moves the head relative to the handle to impart the clamping force at the drive element irrespective of any movement of the handle relative to the drive element.

46 Claims, 6 Drawing Sheets

(56) References Cited

U.S. PATENT DOCUMENTS

| | | | | | |
|---|---|---|---|---|---|
| 2,991,545 | A | * | 7/1961 | Wuischpard | 29/807 |
| 3,015,245 | A | | 1/1962 | Dracka | |
| 3,023,652 | A | | 3/1962 | Feldman | |
| 3,044,335 | A | | 7/1962 | Keranen | |
| 3,575,036 | A | | 4/1971 | Hoffman et al. | |
| 3,656,376 | A | | 4/1972 | Campbell et al. | |
| 3,670,604 | A | | 6/1972 | Fromell | |
| 4,038,987 | A | | 8/1977 | Komiya | |
| 4,084,456 | A | | 4/1978 | Pasbrig | |
| 4,485,700 | A | | 12/1984 | Colvin | |
| 4,488,461 | A | | 12/1984 | Hurtig | |
| 4,513,642 | A | | 4/1985 | Castner, Sr. et al. | |
| 4,532,833 | A | | 8/1985 | Downs | |
| 4,534,246 | A | | 8/1985 | McNulty | |
| 4,546,678 | A | | 10/1985 | Stuckey | |
| 4,611,514 | A | | 9/1986 | Hyde | |
| 4,651,597 | A | | 3/1987 | Yang | |
| 4,747,328 | A | | 5/1988 | Howard | |
| 4,762,032 | A | | 8/1988 | Chow | |
| 4,967,612 | A | | 11/1990 | Sparling | |
| 4,970,917 | A | | 11/1990 | McCollom | |
| 4,970,919 | A | | 11/1990 | Snyder | |
| 5,056,383 | A | | 10/1991 | Halpin | |
| 5,101,693 | A | * | 4/1992 | Chambers | 81/9.43 |
| 5,528,963 | A | | 6/1996 | Wei | |
| 5,557,992 | A | | 9/1996 | Macor | |
| 5,713,248 | A | * | 2/1998 | Franco | 81/3.43 |
| 5,967,002 | A | | 10/1999 | Pijanowski | |
| 6,006,634 | A | | 12/1999 | Byers | |
| 6,016,723 | A | | 1/2000 | Hillinger | |
| 6,070,499 | A | | 6/2000 | Wisbey | |
| 6,189,419 | B1 | | 2/2001 | Pijanowski | |
| 6,237,448 | B1 | | 5/2001 | Haxton | |
| 6,311,584 | B1 | | 11/2001 | Chu | |
| 6,516,688 | B2 | | 2/2003 | Albertson | |
| 6,978,701 | B1 | | 12/2005 | Buchanan | |
| 6,988,430 | B1 | | 1/2006 | Putney et al. | |
| 7,062,994 | B2 | | 6/2006 | Chen | |
| 7,073,413 | B2 | | 7/2006 | Duffy et al. | |
| 7,197,964 | B2 | | 4/2007 | Buchanan | |
| 7,418,890 | B2 | | 9/2008 | Buchanan | |
| 2005/0061115 | A1 | | 3/2005 | Duffy et al. | |
| 2005/0160881 | A1 | | 7/2005 | Niven | |
| 2005/0247168 | A1 | | 11/2005 | Buchanan | |
| 2006/0236818 | A1 | | 10/2006 | Buchanan | |
| 2008/0223179 | A1 | | 9/2008 | Nash et al. | |
| 2010/0058896 | A1 | | 3/2010 | Abel et al. | |

FOREIGN PATENT DOCUMENTS

| | | |
|---|---|---|
| DE | 1603875 | 9/1971 |
| DE | 2522696 | 12/1976 |
| EP | 0122179 | 10/1984 |
| EP | 1510293 | 3/2005 |
| FR | 592653 | 8/1925 |
| GB | 393243 | 6/1933 |
| GB | 658879 | 10/1951 |
| GB | 2007567 | 5/1979 |
| WO | WO2010069865 | 6/2010 |

* cited by examiner

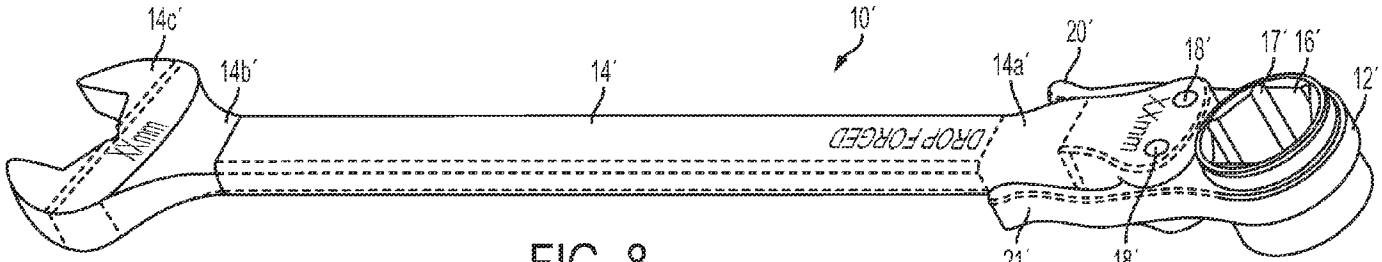
FIG. 8
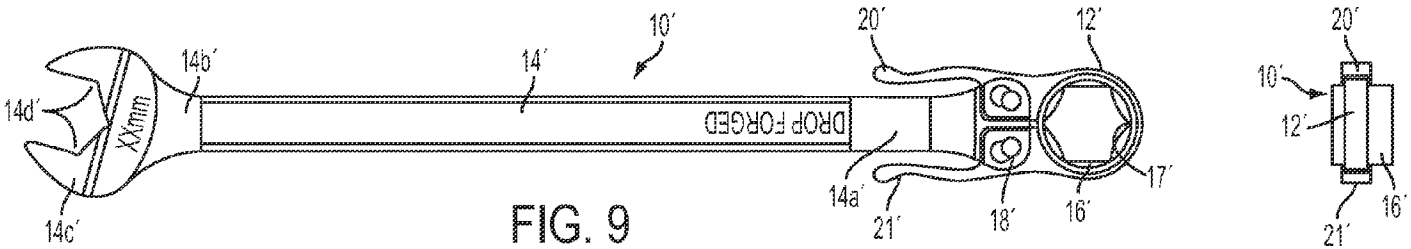
FIG. 10
FIG. 9
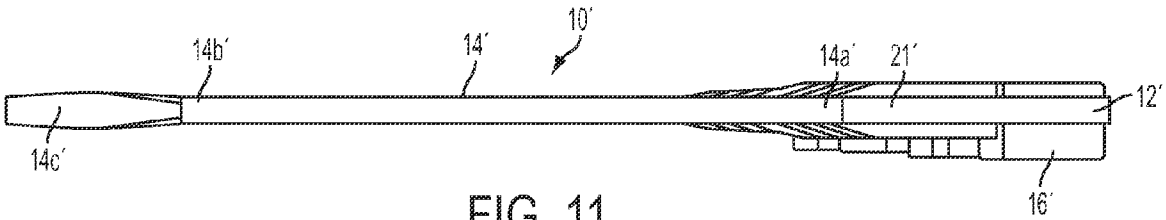
FIG. 11

WRENCH WITH TRIGGER

CROSS REFERENCE TO RELATED APPLICATION

The present application claims the filing benefit of U.S. provisional application Ser. No. 61/371,275, filed Aug. 6, 2011, which is hereby incorporated herein by reference in its entirety.

FIELD OF THE INVENTION

The present invention relates generally to wrenches or one way drive devices also known as "spanners" and, more particularly, to "ring" type wrenches.

BACKGROUND OF THE INVENTION

A wrench is a tool for applying torque to a threaded fastener, such as a nut, bolt, screw or the like, for the purpose of tightening or loosening the fastener. Ring type wrenches are known and function to engage a fastener and drive or rotate the fastener in a given direction. Typically, conventional ring type wrenches have a ring-shaped head with a curved, usually substantially circular, external surface and a hexagonally shaped internal surface (or other shaped internal surface depending on the application of the wrench). In use, the internal surface or surfaces of the wrench head substantially engage the flat surfaces of the fastener (such as a hexagonally shaped fastener head) to put pressure on the fastener surfaces and corners when the fastener is tightened or loosened.

However, if the nut is undersized, damaged or worn, it is likely that the wrench head will "slip" and rotate around the fastener instead of properly gripping or engaging the flats or corners of the fastener. Ring type wrenches are known that, when a force is exerted on the handle and the fastener resists rotation of the socket or ring, the ring may clamp onto the fastener to limit rotation of the ring or head about the fastener. For example, such ring type wrenches are disclosed in U.S. Pat. No. 7,418,890, which is hereby incorporated herein by reference in its entirety. Typically, such ring type wrenches slip around the fastener unless there is enough resistance to rotation of the head by the fastener to cause the ring or head to clamp around the fastener to limit or substantially preclude relative rotation of the ring or head about the fastener.

SUMMARY OF THE INVENTION

The present invention provides a ring type wrench with one or more triggers or levers that function to initially clamp a head portion of the wrench onto a fastener or onto a socket so that the wrench may rotate or drive a fastener with no initial movement or torque required to cause the head portion to clamp onto the fastener or socket. The trigger or triggers may be readily pressed or squeezed or moved by a user of the wrench prior to movement of the handle of the wrench so that the initial movement of the handle rotatably drives the fastener.

According to an aspect of the present invention, a wrench for applying a drive torque at a drive element comprises an elongated handle, a clamping element or head having a torque-applying gripping surface, and a trigger or trigger mechanism. The clamping element or head is adjustably or movably mounted at the handle and is adjustable or movable to impart a clamping force at a drive element received at the gripping surface of the clamping element or head. The trigger is configured to adjust or move the clamping element or head relative to the handle to impart the clamping force at the drive element, whereby, responsive to a user actuating the trigger (such as by squeezing or otherwise moving the trigger relative to the handle), the trigger adjusts or moves the clamping element or head relative to the handle to impart an initial clamping force at the drive element irrespective of and/or before any movement of the handle relative to the drive element.

Therefore, the wrench of the present invention provides enhanced rotation of a fastener or drive element via the trigger or triggers and clamping element of the wrench. The trigger provides for an initial clamping force to be generated at the drive element without requiring any handle rotation about an axis of the drive element and without requiring any resistance to rotation by the drive element. Thus, the trigger may be selectively actuated so that, when the trigger is actuated, an initial rotational movement in a selected direction by the wrench handle imparts a corresponding initial rotation of the drive element, thereby enhancing rotational driving or removing of loose fasteners that may not provide enough resistance to otherwise cause the clamping element to clamp onto the drive element.

These and other objects, advantages, purposes, and features of the present invention will become apparent upon review of the following specification in conjunction with the drawings.

BRIEF DESCRIPTION OF THE DRAWINGS

FIG. 8 is a perspective view of another torque-tightening wrench in accordance with the present invention;

FIG. 9 is a plan view of the wrench of FIG. 8;

FIG. 10 is an end view of the wrench of FIG. 9;

FIG. 11 is a side elevation of the wrench of FIG. 9;

DESCRIPTION OF THE PREFERRED EMBODIMENTS

Figure 1:
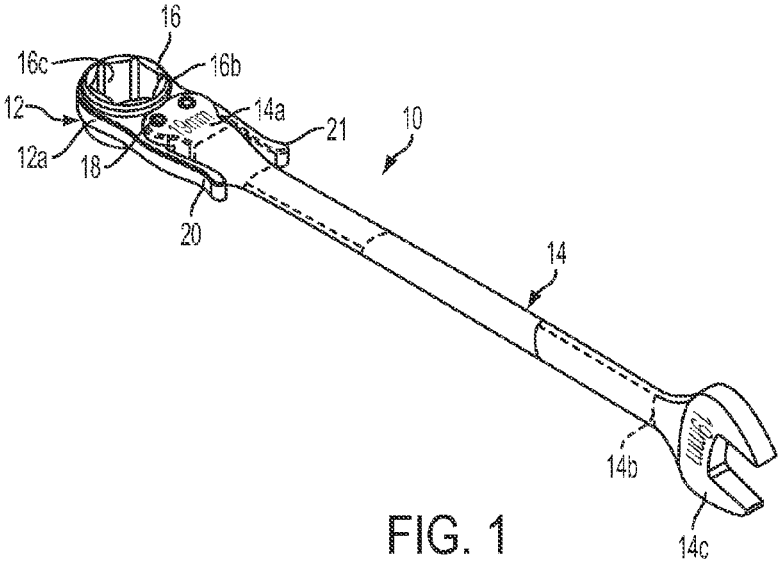
FIG. 1 is a perspective view of a torque-tightening wrench with a circular drive socket located within a flexible ring, and with triggers at the ring for initially clamping the flexible ring about the drive socket in accordance with the present invention.

Referring now to the drawings and the illustrative embodiments depicted therein, a wrench 10 comprises a clamping element or head portion 12 (such as a single flexible ring-like head portion or tension ring or split ring), an elongate handle 14 and a circular socket or drive element 16 rotatably disposed within head portion 12 (FIGS. 1-4). Head portion 12 is pivotably mounted at an end 14*a* of handle 14 via a pair of pins or rivets 18 and is pivotable relative to handle 14 to clamp head portion 12 about circular socket 16 to rotatably drive socket 16 via movement of handle 14. Head portion 12 includes a pair of arms or tabs or triggers 20, 21 extending therefrom that facilitate initial clamping of head portion 12 about socket 16 without having to first move the handle 14 and irrespective of any movement of the handle relative to the socket, while the fit between the head portion and socket allows for substantially free rotation of the socket relative to the head portion when neither of the triggers is moved or squeezed or actuated, as discussed below.

For example, a user may position the socket at a fastener (such as a head of a bolt or a nut or the like), and may press or urge or squeeze or otherwise move one of the triggers 20, 21 toward the wrench handle 14 to impart a clamping force of the head portion 12 about the socket 16 to limit or substantially preclude rotation of the socket within the head portion, whereby the user may rotate or move the handle to rotate the fastener, as also discussed below. The user may actuate the trigger to initially clamp the head portion or ring about the socket with little or no movement of the handle, such that the user, when squeezing or otherwise actuating the trigger, may have the first or initial movement of the handle operate to rotatably drive the fastener. Thus, there is little or no play or slack in the wrench and clamping/driving mechanism such that the handle of the wrench does not have to be initially pivoted or rotated about the fastener an initial amount before the head portion will clamp onto the fastener. Thus, the trigger and head portion and socket cooperate to provide initial clamping of the head portion about the socket irrespective of any movement or rotation of the handle relative to the socket or fastener.

The handle portion 14 of wrench 10 may comprise any suitable shape and material (such as any suitable metallic material, such as drop forged steel and/or such as nickel and/or chrome plated metallic material or the like). In the illustrated embodiment, the end portion 14*a* of handle portion 14 is flattened in a plane that is generally normal to an axis of rotation of the socket 16, while the opposite end portion 14*b* of handle portion 14 may be flattened in a plane that is generally normal to the plane of the first end portion 14*a*. Optionally, the opposite end portion 14*b* may include a box-end wrench 14*c* or the like (such as a box-end wrench of the same size as the size of the socket so that either end of the wrench 10 may be used on the same fastener).

Figure 2:
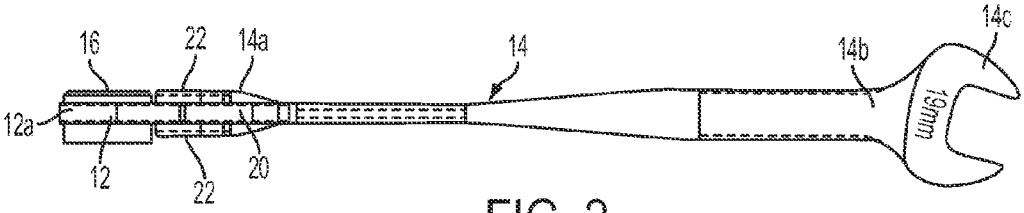
FIG. 2 is a side elevation of the wrench of FIG. 1.
Figure 4:
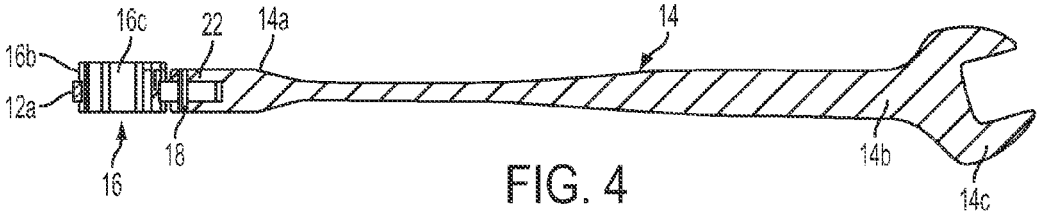
FIG. 4 is a sectional view of the wrench taken along the line IV-IV in FIG. 3.
Figure 5:
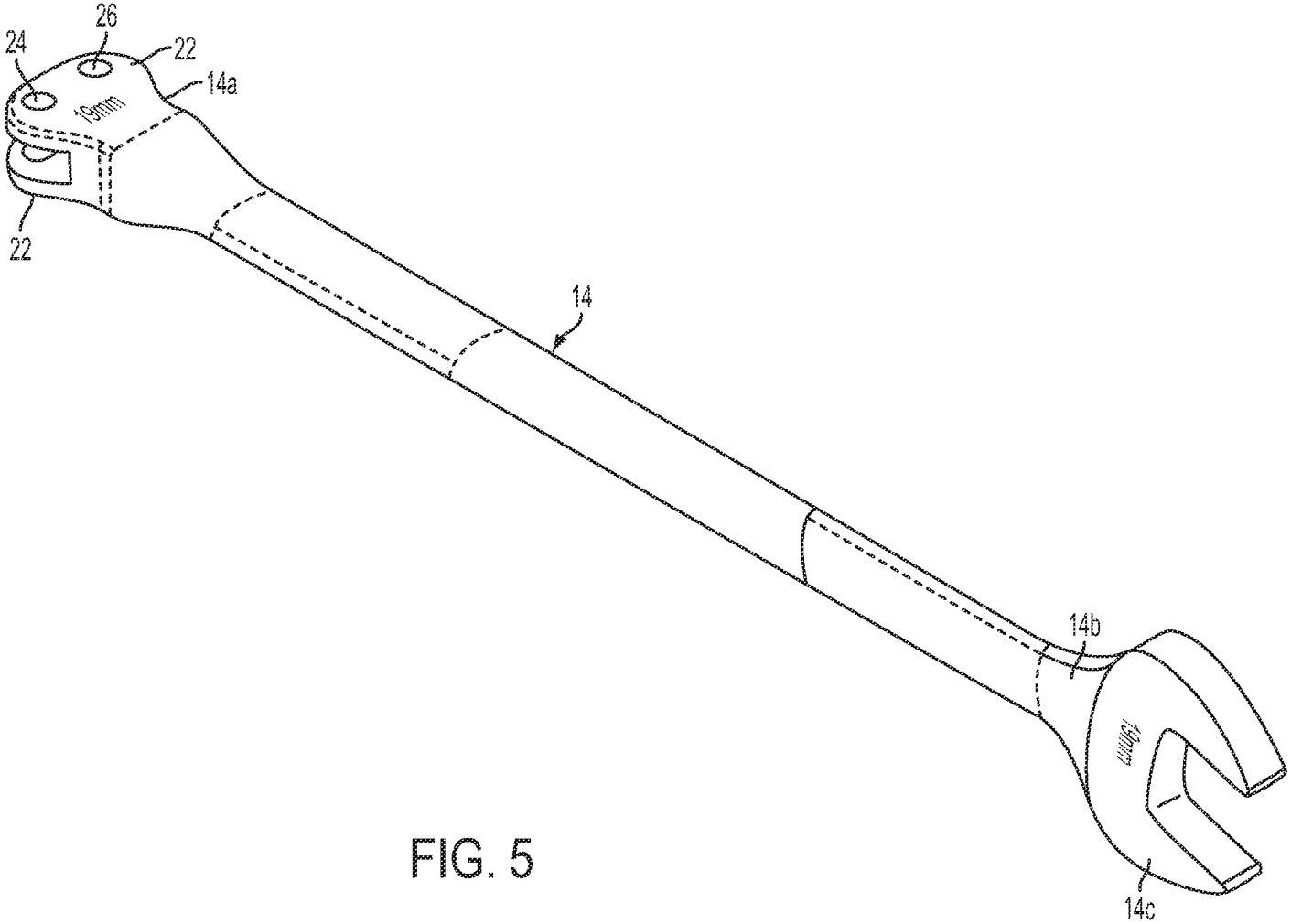
FIG. 5 is a perspective view of the wrench handle portion of the wrench of FIG. 1.

As best shown in FIGS. 2, 4 and 5, end portion 14*a* of handle 14 comprises a pair of spaced apart flanges 22 with a pair of apertures 24, 26 formed or established therethrough. The plates or flanges 22 extend parallel outwardly from the handle in a direction generally parallel to the longitudinal axis of the handle, with the gap between the plates being selected or sized for receiving the head portion 12 therein. The spaced apart flanges 22 are thus configured to receive a base portion of head portion 12 therebetween, whereby pins or rivets 18 are located in the apertures 24, 26 and through apertures or slots 28, 30 (FIG. 6) of head portion 12 for attaching head portion 12 to the handle 14.

Figure 3:
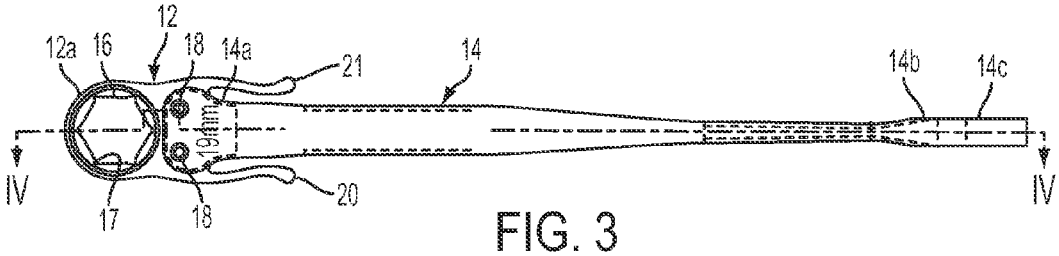
FIG. 3 is another side elevation of the wrench of FIG. 1.
Figure 6:
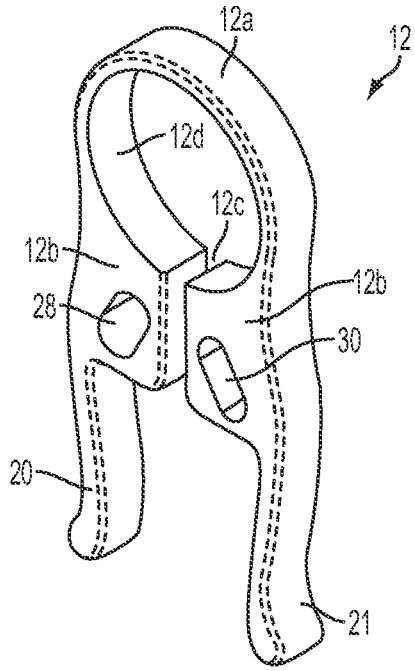
FIG. 6 is a perspective view of the flexible ring and triggers of the wrench of FIG. 1.

As best shown in FIGS. 3 and 6, head portion 12 comprises a split ring-like configuration having a substantially circular ring portion 12*a* extending on opposite sides into a pair of arm or base portions 12*b* separated by a gap 12*c* therebetween. The wall thickness of the ring portion 12*a* is thinnest at its outermost closed end and gradually increases in thickness towards base portions 12*b*. Slots 28, 30 are formed or established at or in or through the respective sides of base portion 12*b*. The slots 28, 30 diverge outwardly from near the gap 12*c* and ring portion 12*a* towards the outermost extremities of the base portions 12*b* distal from the ring portion 12*a*. Rivets 18 extend freely through each slot 28, 30 and through apertures 24, 26, respectively, and function to hold the head portion 12 between the plates 22 of handle 14 for pivotal movement of the head portion 12 relative to the handle 14. Because the rivets 18 extend through the generally circular apertures 24, 26 of handle portion 14 (which may be sized to receive rivets therethrough while limiting relative movement of the rivets in the apertures), the rivets 18 are fixed relative to one another and relative to handle portion 14, while head portion 12 may pivot relative to the end portion 14*a* of handle portion 14 (via movement of the slotted base portion at the rivets) to close or narrow the gap 12*c* and thus to clamp the ring portion 12*a* of head portion 12 around the socket 16.

Figure 7:
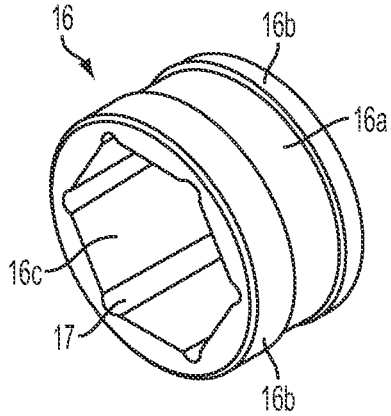
FIG. 7 is a perspective view of the circular drive socket of the wrench of FIG. 1.

Ring portion 12*a* of head portion 12 includes an internal circular surface 12*d* that receives and slidably engages on outer circular surface 16*a* of socket 16 when socket 16 is loosely received in head portion 12 and head portion 12 is not clamped onto socket 16. The inside diameter of the head portion and the outside diameter of the outer circular surface of the socket are dimensioned to provide substantially free rotation of the socket relative to the head portion when neither of the triggers is actuated (with limited or reduced interference between the inner surface of the head portion and the outer surface of the socket). As best shown in FIG. 7, circular surface 16*a* is recessed within and between outer flanges or portions 16*b* of socket 16, such that ring portion 12*a* is received in the recessed surface 16*a* to retain socket 16 at head portion 12.

Socket 16 may comprise any suitable drive member for engaging or receiving a fastener portion therein (such as a nut or a head of a bolt or the like) to rotatably drive the fastener via rotation of the socket. Socket 16 includes an internal polygonal-shaped surface 16*c* (which in the illustrated embodiment comprises a hexagonal configuration, but could be any suitable non-circular shape depending on the particular application of the wrench), with each side of the surface 16*c* comprising a generally flat planar surface for engaging a respective generally flat surface of the fastener received in socket 16. The socket or drive member may comprise any suitable material, such as any suitable metallic material, such as steel and/or such as nickel and/or chrome plated metallic material or the like.

Head portion 12 further includes wings or tabs or arms or triggers 20, 21 extending from respective base portions 12*b*. In the illustrated embodiment, triggers 20, 21 extend generally along the handle portion 14 and may be curved to form a curved trigger-like shape for receiving or partially receiving a user's finger therein. When a user depresses or squeezes one of the triggers 20, 21 toward the handle portion 14, the force imparted at the trigger 20, 21 causes rotation or adjustment or movement or flexing of head portion 12 relative to handle portion 14 with the movement controlled by the pins or rivets 18 moving along slots 28, 30 of head portion 12.

During use of wrench 10, the socket 16 is positioned at a fastener (such as a hexagonal nut or head of a bolt or the like), with the internal surface 16*c* of the socket 16 engaging the fastener. If the fastener resists rotation and the handle is moved in a manner that pivots the handle relative to the head portion, movement of or urging of the handle portion in the direction it is desired to rotate the fastener may result in the ring portion 12*a* of head portion 12 tightening (via closing or partial closing of gap 12*c* as head portion 12 pivots relative to handle portion 14) onto and around socket 16 to urge and move socket 16 with handle portion 14 (such as in a similar manner as described in U.S. Pat. No. 7,418,890, which is hereby incorporated herein by reference in its entirety). However, optionally, and desirably, the user may, after positioning the socket at the fastener, first (and before any rotation of the handle about the fastener) press or squeeze one of the arms or triggers 20, 21 to preload or preset or clamp the ring portion 12*a* onto the socket 16 so that even the initial movement of the handle portion drives the socket and thus the fastener in the desired direction.

Thus, the wrench of the present invention is suited for quickly rotating or driving a fastener in either direction when there is little resistance to such driving rotation of the fastener. A user may repeatedly squeeze the appropriate trigger, rotate the handle in the desired driving direction, release the trigger, rotate the handle back in the opposite direction (with the socket and fastener not rotating as the handle is moved or rotated while the trigger is released), and repeat this process to quickly and efficiently drive (or tighten or loosen and remove) a fastener. The initial clamping at the socket by the ring portion of the head portion in response to a user squeezing one of the triggers allows for easier and more controlled driving of the fastener in the desired direction, and does not require any resistance to rotation on the part of the fastener or any initial movement of the handle before its actually drives the fastener, such as is typically needed for conventional ratchets to function.

For example, movement of trigger 20 towards the wrench handle 14 causes that side or portion of the ring portion 12*a* to move inward (via the rivet moving along a respective slot 28), which results in the gap 12*c* being reduced, and thus results in an increased or initial clamping force at the outer surface 16*a* of socket 16 by the ring portion 12*a*. The increased or initial clamping force via squeezing the trigger is sufficient to drive the fastener even if there is little or no resistance to rotation of the fastener. Once there is sufficient resistance to rotation of the fastener, the wrench head portion and rivets and handle portion function to clamp the head portion tightly onto the socket to drive the socket and fastener, such as in a similar manner as the wrenches described in U.S. Pat. No. 7,418,890, which is hereby incorporated herein by reference in its entirety. As further torque is applied (due to increased resistance to rotation of the fastener as it is tightened), the rivet may move along the slot towards the outer slot end towards the end of the handle portion and the angle or orientation of the slot and the interaction with the rivet causes the ring portion 12*a* to flex and to reduce or close the gap 12*c* and increase the clamping force or pressure on the fastener to drive or tighten the fastener. If it is desired to loosen the fastener (or drive it in the opposite direction), the user may depress or squeeze the other trigger 21 toward the handle portion 14, whereby the force imparted at the trigger 21 causes the opposite rotation or movement or flexing of head portion 12 relative to handle portion 14 with the movement controlled by the pins or rivets 18 moving along slots 28, 30 to clamp the ring portion 12*a* onto the socket 16 for driving the socket and fastener in the opposite direction. The user thus may squeeze a selected or appropriate one of the triggers to drive the socket and fastener in the selected or appropriate direction (for example, by squeezing one trigger the user may drive the socket in one direction and by squeezing the other trigger, the user may drive the socket in the other direction). Optionally, it is envisioned that the wrench may include only one trigger or trigger mechanism, whereby the user may flip the wrench and socket over to change the drive direction of the wrench, while remaining within the spirit and scope of the present invention.

In either of the above fastener driving operations, the closing of the gap 12*c* together with the resilience of the ring headed portion 12*a* cause the ring portion 12*a* to engage and clamp onto the outer cylindrical surface 16*a* of socket 16 to securely clamp and hold the socket relative to the head portion 12 while tightening or loosening the fastener. In either operation, the triggers provide an initial clamping of the ring portion onto the socket prior to any rotational movement of the handle and without any resistance to such rotation at the fastener. Thus, the wrench and triggers of the present invention allow a user to clamp the ring portion onto the socket such that even the initial movement of the wrench handle functions to drive the fastener in the desired direction. The triggers may also function to allow the user to select the rotational drive direction of the wrench (for example, the user may squeeze or actuate one trigger to cause the wrench to drive the fastener in one direction, such as to tighten the fastener, and may squeeze or actuate the other trigger to cause the wrench to drive the fastener in the other direction, such as to loosen the fastener). Although shown and described as having the ring portion 12*a* clamp onto a socket 16 to drive the fastener, it is envisioned that the wrench may not include a separate socket or drive element and that the head portion may have an inner hexagonal or other non-circular shape for directly engaging and clamping onto a hexagonal or non-circular shaped fastener to drive the fastener in a similar manner as described above. Optionally, the socket or drive element may comprise a square shaft drive element or the like, whereby a selected socket may be readily attached at the drive element so that different socket sizes may be used on the wrench, while remaining within the spirit and scope of the present invention.

Although shown in FIGS. 1-7 as having an open ended wrench or box wrench at the end opposite the socket or drive element, it is envisioned that the wrench handle may not include any open ended wrench at its end opposite the socket element, while remaining within the spirit and scope of the present invention. Also, although shown as having a twisted handle portion such that a plane of one end 14*a* of handle portion 14 is generally transverse to a plane of the other end 14*b* of handle portion 14, clearly other handle shapes or designs may be implemented, while remaining within the spirit and scope of the present invention.

For example, and with reference to FIGS. 8-11, a wrench 10' may comprise a generally straight or flat handle portion 14', with a single flexible ring-like head portion 12' at an end 14*a'* of the handle portion 14' (and with a circular socket 16' rotatably disposed within head portion 12') and an open-ended wrench or box-end wrench 14*c'* or the like (such as a box-end wrench of the same size as the size of the socket so that either end of the wrench 10 may be used on the same fastener) at the other end 14*b'* of the handle portion 14'. Head portion 12' includes a pair of arms or tabs or triggers 20', 21' extending therefrom that facilitate initial clamping of head portion 12' about socket 16' without having to first move the handle 14', such as in a similar manner as discussed above. Head portion 12' and rivets 18' and socket end 14*a'* of handle 14' of wrench 10' may be similar to the corresponding components and elements of wrench 10, discussed above, such that a detailed discussion of the wrenches need not be repeated herein.

Optionally, the end of the wrench opposite the socket may comprise a handle portion or any suitable open ended or box wrench or closed-ended wrench or the like. For example, and with reference to FIGS. 1-5, the wrench 10 may comprise a generally square or rectangular receiving portion at wrench end 14*c* (to provide three side contact with a nut or bolt received therein) or, and with reference to FIGS. 8, 9 and 11, the wrench 10' may comprise a partial hex-shaped receiving portion at wrench end 14*c'* (to provide four side contact with a nut or bolt received therein). Optionally, and as shown in FIG. 9, the wrench end 14*c'* may include recesses or relief portions 14*d'* at the corners of the receiving portion. Similarly, the socket 16, 16' may include recesses or relief portions 17, 17' (FIGS. 3 and 7-9) at the corners of the fastener engaging surface of the socket. Optionally, however, the wrench end and socket may comprise generally sharp or squared corners (without relief portions or recesses), while remaining within the spirit and scope of the present invention.

Figure 12:
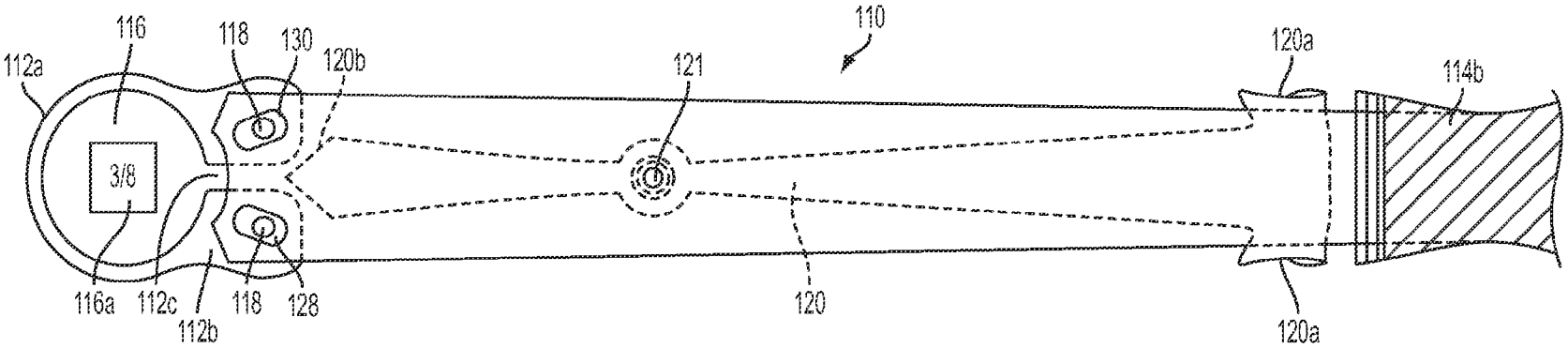
FIG. 12 is a plan view of another wrench in accordance with the present invention, with an elongated trigger mechanism disposed within the shaft of the wrench.
Figure 13:
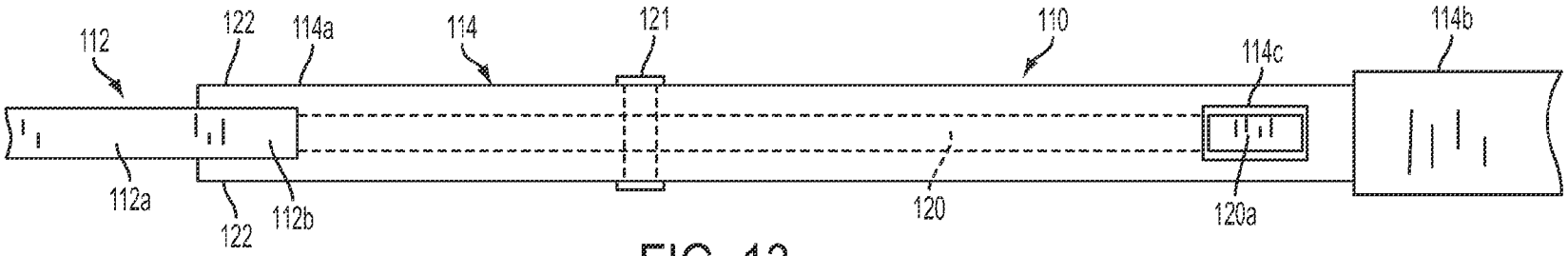
FIG. 13 is a side elevation of the wrench of FIG. 12.

Referring now to FIGS. 12 and 13, a wrench 110 comprises a single flexible ring-like head portion 112, an elongate handle 114 and a circular socket 116 rotatably disposed within head portion 112. Head portion 112 is pivotably mounted at an end 114*a* of handle 114 via a pair of pins or rivets 118 and is pivotable relative to handle 114 to clamp head portion 112 about circular socket 116 to rotatably drive socket 116 via movement of handle 114. Handle 114 includes a lever or trigger 120 extending along handle 114 and pivotally mounted to handle 114 at a pivot pin 121 to facilitate initial clamping of head portion 112 about socket 116 without having to first move the handle 114, such as in a similar manner as discussed above. Head portion 112 and rivets 118 and socket end 114*a* of handle 114 of wrench 110 may be similar to the corresponding components and elements of wrench 10, discussed above, such that a detailed discussion of the wrenches need not be repeated herein.

As shown in FIGS. 12 and 13, lever 120 is pivotally mounted at handle 114 via pivot pin 121 and extends substantially along the length of handle 114, with one or more trigger or finger receiving portions 120*a* disposed at opposite sides of the wrench at or near a grip portion 114*b* of handle 114. In the illustrated embodiment, pivot pin 121 is positioned more towards the drive end of the handle with thumb/finger trigger portions 120*a* at or near the ergonomic hand-grip part 114*b* of the handle 114. The socket end 120*b* of trigger or lever 120 is disposed at the head portion 112 and is configured to engage the head portion 112 and may be configured to be partially received at gap 112*c* of head portion 112. Thus, when a user presses or squeezes one of the trigger portions 120*a*, the socket end 120*b* of trigger 120 pivots accordingly and urges one of the base portions 112*b* of head portion 112 along its respective rivet 118 (via the slots 128, 130 of the base portions 112*b*) to flex ring portion 112*a* to reduce or close the gap 112*c* between the base portions 112*b* and to impart a clamping force on socket 116 by ring portion 112*a*. The trigger 120 thus may provide an initial or preset clamping force at the socket so that any movement of the handle functions to drive the socket and fastener, without requiring any torque or resistance to rotation at the fastener.

In the illustrated embodiment (and as can be seen with reference to FIG. 13), the lever or trigger 120 is disposed within the handle 114, with the socket end 120*b* protruding through an aperture between the spaced apart flanges or plates 122 at the socket or drive end 114*a* of handle 114, and with the trigger portions 120*a* protruding through respective apertures or slots 114*c* along the side of the handle 114 at or near the grip portion 114*b* of handle 114. The pin 121 thus may be inserted through and secured to the opposite sides of the handle 114 and be inserted through an aperture through the trigger or lever 120. In the illustrated embodiment, the socket includes a square driving element 116*a* that is received in a similarly shaped aperture of a selected socket (not shown) for engaging the selected socket with a fastener to drive the fastener via rotation of the handle. However, optionally, the socket may include a non-circular aperture for receiving and engaging a fastener or the ring portion of the head portion may have a non-circular aperture for receiving and engaging a fastener, while remaining within the spirit and scope of the present invention.

Thus, the wrench of the present invention has a fulcrum sandwiched inside of the shaft of the wrench handle with a pivot point more towards the drive end of the handle (to provide greater force at the head portion and reduced travel in response to a lesser force applied at the trigger portions) and with thumb/finger triggers at or near the ergonomic hand-grip part of the handle (so a user may readily press or actuate or squeeze the desired trigger portion while holding the wrench at the grip portion during use of the wrench). When the triggers are depressed in either direction, the activator end or drive end of the fulcrum applies the appropriate pressure to the end of the head portion or socket clamping ring. In turn, the head portion or socket clamping ring instantly (with zero degrees of movement or rotation of the handle) grabs the socket so that the initial movement or rotation of the handle drives or turns the socket and fastener. Release of the trigger allows the socket or square drive insert to rotate freely in either direction. The drive direction can be changed by depressing either trigger to engage the clamping ring when rotating in either direction.

While the embodiments shown and described herein are shown to have a polygonal internal surface of the socket, such as hexagonal, such internal surfaces may comprise any suitable surface or shape depending on the particular application of the wrench. For example, any non-circular shape may be selected to correspond to the shape of the targeted fastener to which the wrench is to be applied. Optionally, the socket may comprise a square drive element or insert for attachment of a selected hexagonal socket or twelve point socket or the like. Optionally, the wrench of the present invention may not have a circular socket, and instead the head portion may have a desired engaging surface for engaging a fastener (such as a partial hexagonal shape or non-circular shape or circular shape), whereby the triggers may cause initial clamping of the head portion onto and around the fastener head. Wherever a cylindrical/circular construction is used, it may be desirable for clamping onto fasteners having burred edges or cylindrical sockets provided with internal polygonal surfaces to engage a bolt head having similarly polygonal external surfaces.

Therefore, the present invention provides a wrench or socket with a ratchet type mechanism (such as a gearless or toothless ratchet mechanism or substantially infinitely adjustable ratchet mechanism or the like) that allows for substantially free rotation of the socket within the head portion or tension ring when neither of the triggers is moved or squeezed or actuated, yet provides an initial clamping force by the head portion or tension ring on the socket to limit or substantially preclude relative rotation between the head portion and socket to facilitate driving of the socket (and fastener received therein) even when there is little or no resistance to rotation of the socket and/or fastener. The present invention thus provides enhanced control of the wrench and allows the user of the wrench to apply the wrench in areas with little clearance or room to move the handle, whereby the ease of squeezing/actuating the trigger and releasing the trigger provides for quick and controlled driving of the socket with little movement of the handle portion of the wrench and irrespective of any movement of the handle portion relative to the socket and/or fastener.

Changes and modifications to the specifically-described embodiments may be carried out without departing from the principles of the present invention, which is intended to be limited only by the scope of the appended claims, as interpreted according to the principles of patent law, including the doctrine of equivalents.

The invention claimed is:

1. A wrench for applying a drive torque at a drive element, said wrench comprising:

an elongated handle;

a clamping element comprising a torque-applying gripping surface;

a drive element received at said torque-applying gripping surface of said clamping element;

wherein said clamping element is adjustably mounted at said handle and is adjustable to impart a clamping force at said drive element;

a trigger configured to adjust said clamping element relative to said handle to impart said clamping force at said drive element;

wherein, responsive to a user actuating said trigger, said trigger adjusts said clamping element relative to said handle to impart said clamping force at said drive element irrespective of any movement of said handle relative to said drive element;

wherein said trigger comprises an elongated lever pivotally mounted at said handle with a user actuatable portion at or near a grip portion of said handle and a clamping element engaging portion at an opposite end of said lever for engaging said clamping element; and wherein said clamping element engaging portion of said trigger is disposed at a gap established in said clamping element.

2. A wrench for applying a drive torque at a drive element, said wrench comprising:

an elongated handle;

a clamping element comprising a torque-applying gripping surface;

a drive element received at said torque-applying gripping surface of said clamping element;

wherein said clamping element is adjustably mounted at said handle and is adjustable to impart a clamping force at said drive element;

a trigger configured to adjust said clamping element relative to said handle to impart said clamping force at said drive element;

wherein, responsive to a user actuating said trigger, said trigger adjusts said clamping element relative to said handle to impart said clamping force at said drive element irrespective of any movement of said handle relative to said drive element; and wherein said trigger comprises a lever that extends from said clamping element and at least partially along said handle.

3. The wrench of claim 2, wherein, responsive to a user actuating said trigger before any rotation of said handle relative to said drive element, said trigger adjusts said clamping element relative to said handle to impart said clamping force at said drive element before any rotation of said handle relative to said drive element.

4. The wrench of claim 2, wherein said trigger comprises an elongated lever pivotally mounted at said handle with a user actuatable portion at or near a grip portion of said handle and a clamping element engaging portion at an opposite end of said lever for engaging said clamping element.

5. The wrench of claim 4, wherein said trigger is pivotally mounted at said handle via a pivot pin and wherein said pivot pin is disposed at said handle closer to said clamping element than said grip portion.

6. The wrench of claim 4, wherein said trigger is disposed at least partially within said handle, and wherein said user actuatable portion protrudes at least partially outward from said handle for actuating by a user of said wrench.

7. The wrench of claim 2, wherein said trigger comprises a pair of levers that extend from respective sides of said clamping element and at least partially along said handle.

8. The wrench of claim 7, wherein each of said levers adjusts said clamping element relative to said handle in a respective direction responsive to a user actuating the respective trigger to impart said clamping force at the drive element to rotatably drive said drive element in a respective direction.

9. The wrench of claim 2, wherein said clamping element has a gap with opposed portions of said clamping portion defining said gap therebetween, and wherein, responsive to a user actuating said trigger, said trigger adjusts said clamping element relative to said handle to reduce said gap to impart said clamping force at said drive element.

10. The wrench of claim 2, wherein said torque-applying gripping surface of said clamping element comprises a generally cylindrical gripping surface and said drive element comprises a generally cylindrical outer surface that is engaged by and clamped by said torque-applying gripping surface of said clamping element.

11. The wrench of claim 2, wherein said drive element is configured to one of (a) receive a fastener therein and (b) attach to a socket that is configured to receive a fastener therein.

12. A wrench for applying a drive torque at a drive element, said wrench comprising:

an elongated handle;

a clamping element comprising a torque-applying gripping surface;

a drive element received at said torque-applying gripping surface of said clamping element;

wherein said clamping element is adjustably mounted at said handle and is adjustable to impart a clamping force at said drive element;

a trigger configured to adjust said clamping element relative to said handle to impart said clamping force at said drive element;

wherein, responsive to a user actuating said trigger, said trigger adjusts said clamping element relative to said handle to impart said clamping force at said drive element irrespective of any movement of said handle relative to said drive element;

wherein said clamping element has a gap with opposed portions of said clamping portion defining said gap therebetween, and wherein, responsive to a user actuating said trigger, said trigger adjusts said clamping element relative to said handle to reduce said gap to impart said clamping force at said drive element; and wherein said clamping element and said handle are retained together via a pair of rivets disposed through apertures in said handle and slots in said clamping element.

13. The wrench of claim 12, wherein said clamping element, said handle and said rivets cooperate to at least partially close said gap between said opposed portions of said clamping element and increase said clamping force applied by said torque-applying gripping surface as more torque is applied at said handle.

14. The wrench of claim 12, wherein said slots in said clamping element diverge outwardly towards respective sides of said handle as they extend generally towards a grip portion of said handle.

15. The wrench of claim 12, wherein said trigger comprises a lever that extends from a side region of said clamping element generally near one of said opposed portions of said clamping element and wherein said trigger extends at least partially along said handle.

16. The wrench of claim 12, wherein said wrench comprises a pair of levers, with each lever extending from a respective opposite side region of said clamping element generally near a respective one of said opposed portions of said clamping element and wherein said levers extend at least partially along said handle.

17. The wrench of claim 14, wherein said trigger comprises an elongated lever pivotally mounted at said handle with a user actuatable portion at or near a grip portion of said handle and a clamping element engaging portion at an opposite end of said lever for engaging said clamping element.

18. The wrench of claim 17, wherein said clamping element engaging portion of said trigger is generally disposed at said gap of said clamping element for engaging a respective one of said opposed portions of said clamping element when said trigger is actuated.

19. A wrench for applying a drive torque at a drive element, said wrench comprising:

an elongated handle;

a clamping element comprising a torque-applying gripping surface;

a drive element received at said torque-applying gripping surface of said clamping element;

wherein said clamping element is adjustably mounted at said handle and is adjustable to impart a clamping force at said drive element;

a trigger configured to adjust said clamping element relative to said handle to impart said clamping force at said drive element;

wherein, responsive to a user actuating said trigger, said trigger adjusts said clamping element relative to said handle to impart said clamping force at said drive element irrespective of any movement of said handle relative to said drive element; and wherein said drive element comprises a fastener and wherein said clamping element is adjustable to impart said clamping force at a head portion of said fastener received at said torque-applying gripping surface of said clamping element.

20. The wrench of claim 19, wherein said torque-applying gripping surface of said clamping element comprises a non-circular gripping surface and said head portion of said fastener comprises a generally non-cylindrical outer surface that is engaged by and clamped by said torque-applying gripping surface of said clamping element.

21. The wrench of claim 19, wherein said torque-applying gripping surface of said clamping element comprises a generally circular gripping surface and said head portion of said fastener comprises a generally cylindrical outer surface that is engaged by and clamped by said torque-applying gripping surface of said clamping element.

22. A wrench for applying a drive torque at a drive element, said wrench comprising:

an elongated handle;

a flexible head having a split aperture therein that defines a torque-applying gripping surface;

wherein said flexible head is movably mounted at said handle and is movable to impart a clamping force at a drive element received at said torque-applying gripping surface of said flexible head;

a trigger configured to move said flexible head relative to said handle to impart said clamping force at said drive element;

wherein, responsive to a user actuating said trigger, said trigger moves said flexible head relative to said handle to impart said clamping force at said drive element irrespective of any movement of said handle relative to said drive element; and wherein said head engaging portion of said trigger is disposed at a gap established in said flexible head.

23. A wrench for applying a drive torque at a drive element, said wrench comprising:

an elongated handle;

a flexible head having a split aperture therein that defines a torque-applying gripping surface;

wherein said flexible head is movably mounted at said handle and is movable to impart a clamping force at a drive element received at said torque-applying gripping surface of said flexible head;

a trigger configured to move said flexible head relative to said handle to impart said clamping force at said drive element;

wherein, responsive to a user actuating said trigger, said trigger moves said flexible head relative to said handle to impart said clamping force at said drive element irrespective of any movement of said handle relative to said drive element; and wherein said trigger comprises a lever that extends from said flexible head and at least partially along said handle.

24. The wrench of claim 23, wherein, responsive to a user actuating said trigger before any rotation of said handle relative to said drive element, said trigger moves said flexible head relative to said handle to impart said clamping force at said drive element before any rotation of said handle relative to said drive element.

25. The wrench of claim 23, wherein said trigger comprises an elongated lever pivotally mounted at said handle with a user actuatable portion at or near a grip portion of said handle and a head engaging portion at an opposite end of said lever for engaging said flexible head.

26. The wrench of claim 25, wherein said trigger is pivotally mounted at said handle via a pivot pin and wherein said pivot pin is disposed at said handle closer to said flexible head than said grip portion.

27. The wrench of claim 25, wherein said trigger is disposed at least partially within said handle, and wherein said user actuatable portion protrudes at least partially outward from said handle for actuating by a user of said wrench.

28. The wrench of claim 23, wherein said trigger comprises a pair of levers that extend from respective sides of said flexible head and at least partially along said handle.

29. The wrench of claim 28, wherein each of said levers moves said flexible head relative to said handle in a respective direction responsive to a user actuating the respective trigger to impart said clamping force at the drive element to rotatably drive said drive element in a respective direction.

30. The wrench of claim 23, wherein said flexible head has a gap with opposed portions of said flexible head defining said gap therebetween, and wherein, responsive to a user actuating said trigger, said trigger flexes said flexible head to reduce said gap to impart said clamping force at said drive element.

31. The wrench of claim 23, wherein said torque-applying gripping surface of said flexible head comprises a generally cylindrical gripping surface and said drive element comprises a generally cylindrical outer surface that is engaged by and clamped by said torque-applying gripping surface of said flexible head.

32. The wrench of claim 31, wherein said drive element is configured to one of (a) receive a fastener therein and (b) attach to a socket that is configured to receive a fastener therein.

33. A wrench for applying for applying a drive torque at a drive element, said wrench comprising:

an elongated handle;

a flexible head having a split aperture therein that defines a torque-applying gripping surface;

wherein said flexible head is movably mounted at said handle and is movable to impart a clamping force at a drive element received at said torque-applying gripping surface of said flexible head;

a trigger configured to move said flexible head relative to said handle to impart said clamping force at said drive element;

wherein, responsive to a user actuating said trigger, said trigger moves said flexible head relative to said handle to impart said clamping force at said drive element irrespective of any movement of said handle relative to said drive element; and wherein said flexible head and said handle are retained together via a pair of rivets disposed through apertures in said handle and slots in said flexible head.

34. The wrench of claim 33, wherein said flexible head, said handle and said rivets cooperate to at least partially close said gap of said flexible head and increase said clamping force applied by said torque-applying gripping surface as more torque is applied at said handle.

35. The wrench of claim 34, wherein said slots in said flexible head diverge outwardly towards respective sides of said handle as they extend generally towards a grip portion of said handle.

36. The wrench of claim 35, wherein said trigger comprises a lever that extends from a side region of said flexible head generally near one of said opposed portions of said flexible head and wherein said trigger extends at least partially along said handle.

37. The wrench of claim 36, wherein said wrench comprises a pair of levers, with each lever extending from a respective opposite side region of said flexible head generally near a respective one of said opposed portions of said flexible head and wherein said levers extend at least partially along said handle.

38. The wrench of claim 35, wherein said trigger comprises an elongated lever pivotally mounted at said handle with a user actuatable portion at or near a grip portion of said handle and a head engaging portion at an opposite end of said lever for engaging said flexible head.

39. The wrench of claim 38, wherein said head engaging portion of said trigger is generally disposed at said gap of said flexible head for engaging a respective one of said opposed portions of said flexible head when said trigger is actuated.

40. A wrench for applying a drive torque at a drive element, said wrench comprising:

an elongated handle;

a flexible head having a split aperture therein that defines a torque-applying gripping surface;

wherein said flexible head is movably mounted at said handle and is movable to impart a clamping force at a drive element received at said torque-applying gripping surface of said flexible head;

a trigger configured to move said flexible head relative to said handle to impart said clamping force at said drive element;

wherein, responsive to a user actuating said trigger, said trigger moves said flexible head relative to said handle to impart said clamping force at said drive element irrespective of an movement of said handle relative to said drive element; and wherein said drive element comprises a fastener and wherein said flexible head is adjustable to impart said clamping force at a portion of said fastener received at said torque-applying gripping surface of said flexible head.

41. The wrench of claim 40, wherein said torque-applying gripping surface of said flexible head comprises a non-circular gripping surface and said portion of said fastener comprises a generally non-cylindrical outer surface that is engaged by and clamped by said torque-applying gripping surface of said flexible head.

42. The wrench of claim 40, wherein said torque-applying gripping surface of said flexible head comprises a generally circular gripping surface and said portion of said fastener comprises a generally cylindrical outer surface that is engaged by and clamped by said torque-applying gripping surface of said flexible head.

43. A wrench for applying a drive torque at a drive element, said wrench comprising:

an elongated handle;

a clamping element comprising a split ring with opposed portions defining a gap therebetween, wherein said clamping element comprises a torque-applying gripping surface and wherein said torque-applying gripping surface comprises an inner generally cylindrical gripping surface;

a drive element received at said torque-applying gripping surface of said clamping element, wherein said drive element has an outer generally cylindrical driving surface that at least partially engages said torque-applying gripping surface of said clamping element when said drive element is received thereat;

wherein said clamping element is adjustably mounted at said handle and is adjustable to reduce said gap and impart a clamping force at said drive element;

a trigger configured to adjust said clamping element relative to said handle to reduce said gap and impart said clamping force at said drive element;

wherein, responsive to a user actuating said trigger without any rotation of said handle relative to said drive element, said trigger adjusts said clamping element relative to said handle to impart an initial clamping force at said drive element without any rotation of said handle relative to said drive element, whereby said initial clamping force at said drive element causes said drive element to rotate with said handle upon initial rotation of said handle about an axis of said drive element; and wherein said trigger comprises a pair of levers that each extend from a respective side region of said clamping element generally near a respective one of said opposed portions of said clamping element and wherein said levers extend at least partially along said handle, and wherein each of said levers adjusts said clamping element relative to said handle in a respective direction responsive to a user actuating the respective trigger to reduce said gap and impart said initial clamping force at said drive element for rotatably driving said drive element in a respective direction.

44. The wrench of claim 43, wherein said clamping element comprises a flexible split ring and wherein said clamping element flexes to reduce said gap and apply said clamping force at said drive element.

45. A wrench for applying a drive torque at a drive element, said wrench comprising:

an elongated handle;

a clamping element comprising a split ring with opposed portions defining a gap therebetween, wherein said clamping element comprises a torque-applying gripping surface and wherein said torque-applying gripping surface comprises an inner generally cylindrical gripping surface;

a drive element received at said torque-applying gripping surface of said clamping element, wherein said drive element has an outer generally cylindrical driving surface that at least partially engages said torque-applying gripping surface of said clamping element when said drive element is received thereat;

wherein said clamping element is adjustably mounted at said handle and is adjustable to reduce said gap and impart a clamping force at said drive element;

a trigger configured to adjust said clamping element relative to said handle to reduce said gap and impart said clamping force at said drive element;

wherein, responsive to a user actuating said trigger without an rotation of said handle relative to said drive element, said trigger adjusts said clamping element relative to said handle to impart an initial clamping force at said drive element without any rotation of said handle relative to said drive element, whereby said initial clamping force at said drive element causes said drive element to rotate with said handle upon initial rotation of said handle about an axis of said drive element; and wherein said clamping element and said handle are retained together via a pair of rivets disposed through apertures in said handle and slots in said clamping element, and wherein said slots in said clamping element diverge outwardly towards respective sides of said handle as they extend generally towards a grip portion of said handle, and wherein said clamping element, said handle and said rivets cooperate to reduce said gap between said opposed portions of said clamping element and increase said clamping force applied by said torque-applying gripping surface as more torque is applied at said handle.

46. The wrench of claim 45, wherein said trigger comprises an elongated lever pivotally mounted at said handle with a user actuatable portion at or near a grip portion of said handle and a clamping element engaging portion at an opposite end of said lever for engaging said clamping element, and wherein said clamping element engaging portion of said trigger is disposed generally at said gap for engagement of one of said opposed portions of said clamping element when said trigger is actuated to reduce said gap and impart said initial clamping force at said drive element for rotatably driving said drive element in a respective direction.

* * * * *

UNITED STATES PATENT AND TRADEMARK OFFICE

CERTIFICATE OF CORRECTION

PATENT NO. : 8,607,671 B2
APPLICATION NO. : 13/196985
DATED : December 17, 2013
INVENTOR(S) :Peirce et al.

It is certified that error appears in the above-identified patent and that said Letters Patent is hereby corrected as shown below:

In the claims

Column 10
Line 56, Claim 14, delete "12" insert --11--
Line 60, Claim 15, delete "12" insert --14--
Line 65, Claim 16, delete "12" insert --15--

Column 12
Line 62, Claim 33, delete "for applying" after --for applying-- (first occurrence)

Column 13
Line 60, Claim 40, delete "an" insert --any--

Column 15
Line 14, Claim 45, delete "an" insert --any--

Signed and Sealed this
Twenty-second Day of March, 2016

Michelle K. Lee

Michelle K. Lee
*Director of the United States Patent and Trademark Office*